US006305792B1

(12) United States Patent
Otsuka et al.

(10) Patent No.: US 6,305,792 B1
(45) **Date of Patent: *Oct. 23, 2001**

(54) INK JET RECORDING HEAD

(75) Inventors: Yasuhiro Otsuka; Torahiko Kanda; Masakazu Okuda; Fuminori Takizawa, all of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,327

(22) Filed: Apr. 15, 1999

(30) Foreign Application Priority Data

Apr. 17, 1998 (JP) ..... 10-107971

(51) Int. Cl.[7] ..... B41S 2/045
(52) U.S. Cl. ..... 347/71
(58) Field of Search ..... 347/70, 71, 47

(56) References Cited

U.S. PATENT DOCUMENTS

| | | | | |
|---|---|---|---|---|
| 4,558,333 | | 12/1985 | Sugitani et al. . | |
| 4,694,308 | | 9/1987 | Chan et al. | 346/140 |
| 4,716,423 | | 12/1987 | Chan et al. | 346/140 |
| 5,453,767 | * | 9/1995 | Chang et al. | 347/70 X |
| 5,646,662 | * | 7/1997 | Kitahara | 347/47 X |
| 5,748,214 | | 5/1998 | Usui et al. | 347/70 |
| 5,997,134 | | 12/1999 | Hotomi et al. | 347/70 |

FOREIGN PATENT DOCUMENTS

| | | | | |
|---|---|---|---|---|
| 0 426 473 | | 5/1991 | (EP) . | |
| 738 599 A2 | * | 10/1996 | (EP) | 347/70 |
| 63502015 | | 8/1988 | (JP) . | |
| 3274157 | | 12/1991 | (JP) . | |
| 4047947 | | 2/1992 | (JP) . | |
| 4052213 | | 2/1992 | (JP) . | |
| 7195687 | | 8/1995 | (JP) . | |
| 7246701 | | 9/1995 | (JP) . | |
| 8058089 | | 3/1996 | (JP) . | |
| 8267743 | | 10/1996 | (JP) . | |
| 8-336966 | | 12/1996 | (JP) . | |
| 10772 | | 1/1998 | (JP) . | |
| 92/10367 | | 6/1992 | (WO) . | |
| 97/34769 | | 9/1997 | (WO) . | |

OTHER PUBLICATIONS

Patent Abstracts of Japan, vol. 95, No. 6, JP 7–148930A, Jun. 1995.*

Tomoaki; "Ink Jet Head"; Patent Abstracts of Japan; vol. 016, No. 094; Mar. 9, 1992; Publication No.: 03 274157; Publication Date: Dec. 5, 1991; Abstract.

* cited by examiner

*Primary Examiner*—Benjamin R. Fuller
*Assistant Examiner*—C Dickens
(74) *Attorney, Agent, or Firm*—Foley & Lardner

(57) ABSTRACT

In order to reduce a manufacturing cost of an ink jet type recording head by simplifying a structure of the ink jet type recording head and reducing the number of manufacturing steps thereof, to provide a capacity of an ink pool without increasing a size thereof, to make the freedom of nozzle layout high and to make the freedom of design by reducing a restriction on position and number of ink supply ports, the ink pool to which ink is supplied is formed in a rear surface of a nozzle plate having a front surface formed with a plurality of nozzles and an ink chamber plate is attached to the rear surface of the nozzle plate through discrete partition walls each defining a discrete space communicating with different one of the nozzles.

15 Claims, 16 Drawing Sheets

INK JET RECORDING HEAD

CROSS REFERENCE TO RELATED APPLICATIONS

The present invention claims priority from Japanese Patent Application No. 10-107971 filed Apr. 17, 1998, the contents of which are incorporated herein by reference.

BACKGROUND OF THE INVENTION

1. Field of the Invention

The present invention is utilized in an ink jet type printer or recorder. The present invention is utilized in a device which includes a recording head provided with a plurality of regularly arranged nozzles from which ink droplets are selectively jetted correspondingly to an externally supplied image signal and is adapted to print characters or drawings by scanning a paper or the like with the recording head. Particularly, the present invention relates to an ink jet type recording head having a simplified construction and an increased nozzle density.

2. Description of Related Art

An ink jet type recording head operates such that a plurality (n) of nozzles, where, in a case of a multicolor recording head, n is, for example, 24 to 300 for each color, thereof selectively jet droplets correspondingly to an electric signal (printing data) and print characters or a drawing on a recording medium such as paper sheet by scanning the paper sheet along a surface thereof with the recording head. The ink jet type recording head generally includes at least one ink pool which is provided commonly for a plurality of nozzles and in which ink is reserved. Ink in the ink pool is introduced into pressure chambers through thin ink supply passages communicating with the respective nozzles and ink droplets are jetted from selected ones of the nozzles by pressurizing ink in the corresponding pressure chambers by a pressure generator for generating a pressure correspondingly to an electric signal.

When the droplets are jetted from the selected ones of the nozzles by pressurizing ink in the corresponding pressure chambers which are connected to the respective nozzles, a pressure wave is produced by the pressurization of ink in the pressure chambers and propagates back to the ink pool which is common to the pressure chambers. Such pressure wave propagation may adversely influence the ink jetting condition of other nozzles than the selected nozzles as so-called sound cross talk and, in some extreme case, the other nozzles may be caused to jet a small amount of ink.

In order to make the recording head compact, it is necessary to reduce the size of the ink pool. However, when the number of nozzles to be driven simultaneously is increased and the capacity of the ink pool is not sufficient to accommodate this, the amount of ink to be supplied from the ink pool to the pressure chambers is a insufficient and stable ink jet operation becomes impossible.

To realize stable ink jet operation regardless of the number of nozzles to be driven simultaneously by preventing sound cross-talk and the shortage of the ink supply from occurring, to make the size of the whole recording head small by increasing the nozzle density or by increasing the number of nozzles in a predetermined head size, and to fabricate the recording head at low cost by simplifying the head structure, are ever present problems associated with ink jet type recording heads.

Japanese Patent Application Laid-open No. Hei 8-58089 discloses an example of a structure of an ink jet type recording head which is constructed via lamination of a plurality of punched plate materials. FIG. 1 is a cross section of the head and FIG. 2 is an exploded perspective view of this structure. In FIGS. 1 and 2, an ink pool 30 is provided in one (101) of the plates and is used commonly by a plurality (n) of nozzles 31. Ink reserved in the ink pool 30 is introduced to ink supply passages 33 provided for the respective nozzles 31 through respective ink supply ports 32 and further introduced to pressure chambers 34 provided in another plate (104).

As shown in FIGS. 1 and 2, the ink jet recording head is constituted with a nozzle plate 100, an ink reservoir chamber or an ink pool forming plate 101, an ink supply port forming plate 102, a sealing plate 103, a pressure chamber forming plate 104 and a vibrator plate 105, which are laminated in order to form ink passages from the ink pool 30 to the respective nozzles 31. Further, the ink jet type recording head comprises an actuator constituted of piezo-electric elements 106, an upper electrode 107 and a flexible printed circuit board 108, etc.

In this structure of ink jet recording head, the nozzle 31 can be arranged in two rows in a flat plane as shown in FIG. 2. Therefore, it is possible to double the nozzle density in a sub scan direction by shifting nozzle positions in one row with respect to those in the other row. However, this structure is complicated due to the large number of the plates to be laminated and, therefore, there is a problem in the fabrication steps for machining parts in the respective plates, positioning them precisely in laminating them and adhering and/or bonding them to each other. Further, in the ink jet recording head having this structure, the ink pool 30 is arranged such that it overlaps the ink supply passage 33 only partially and does not overlap the pressure chamber 34 and the nozzle 31. Therefore, an area of the ink jet type recording head which is occupied by the ink pool is small with respect to the whole area of the ink jet type recording head and, in order to make the ink pool sufficiently large, the head must be also large.

As an ink jet recording head whose number of plates to be laminated is reduced, Japanese Patent Publication No. Hei 4-52213 discloses a structure in which pressure chambers, nozzles in communication with these pressure chambers and ink supply passages are formed in one and single plate. This structure is shown in FIG. 3, which is a cross section of the head, and FIG. 4 which is a disassembled perspective view of the same. In FIGS. 3 and 4, a piezo-electric element 114 is supported in contact with a vibrator plate 113 by a rigid member 116. This plate mechanically vibrates in response to an electric signal supplied externally through electrodes 112 and 115. The vibration of the piezo-electric element 114 is transmitted to the pressure chambers 44 through the vibrator plate 113. Thus, ink is supplied from an ink pool 117 through the ink passages 111 to the nozzles 41.

The structure of the ink jet recording head shown in FIGS. 3 and 4, is advantageous in that the number of plates to be laminated is small. However, as will be clear from FIG. 3, a precise machining of the ink pool, the pressure chambers and the nozzles, which have different configurations, in the substrate plate 40 is required, which leads to an increase of the fabrication steps. Further, in this structure, the ink pool 117 must be arranged next to the pressure chambers 44 due to which a reduction of the size of the whole recording head becomes difficult.

Japanese Patent Application Laid-open No. Hei 3-274157 discloses an ink jet recording head in which the nozzle density in a sub scan direction is made large by arranging nozzles in a matrix in plan view. However, the technique disclosed therein is related to a structure of an electro-mechanical transducer element for driving pressure chambers arranged in a matrix and is not a technique for arranging them in a matrix according ink flow.

Japanese Patent Application Laid-open No. Hei 7-246701 discloses an ink jet type recording head designed to achieve both a compact ink jet head and a reliable ink supply to all of pressure chambers. The structural arrangement of this ink jet head is shown in FIG. 5 which is a disassembled perspective view thereof and FIG. 6 which is a cross section thereof. As shown in FIGS. 5 and 6, a plurality of nozzles 97 and a corresponding number of pressure chambers 119 in communication with the respective nozzles 97 are formed and ink reserving chambers 120 for temporarily reserving ink to be supplied to the pressure chambers 119 is provided in communication with the pressure chambers 119.

Since, in this structure, the ink reserving chambers 120 can be arranged in overlapping relation to the plurality of the pressure chambers 119 in a vertical plane parallel to an ink jet head plate 118 including a front side plate 125, an intermediate plate 126 and a rear plate 127, it is superior to the structures shown in FIGS. 1 and 2 and FIGS. 3 and 4 in that a larger ink reserving chamber can be formed. However, the nozzle ports 97 and the ink supply passages 121 can not overlap the ink jet head 118. Further, in the structure shown in FIGS. 5 and 6, the ink jet head plate 118 for forming the passages from the ink reserving chambers 120 to the nozzle ports 97 has a three-layer structure. Therefore, in assembling these three plates 125, 126 and 127, a precise positioning of the ink supplies 121 and the pressure chambers 119 and a precise positioning of the pressure chambers 119 and the nozzle ports 97 formed in the two platesl25 and 126 are required, which cause the number of fabrication steps to be increased. This problem is similar to that of encountered with the structure shown in FIGS. 1 and 2.

In the structure shown in FIGS. 5 and 6, the ink reserving chamber 120, for example, is formed in the front side plate 125 by a precision machining requiring a precise depth control. Therefore, the number of fabrication steps is increased and the yield of machining of the parts is lowered. This is similar to that of the structure shown in FIGS. 3 and 4.

SUMMARY OF THE INVENTION

An object of the present invention is to provide an ink jet type recording head which has a simple structure, requires a reduced number of fabrication steps and is compact and inexpensive.

Another object of the present invention is to provide an ink jet type recording head which can improve the yield thereof.

Another object of the present invention is to provide an ink jet type recording head, which has a high layout freedom of, nozzles and low restriction in position and number of ink supply ports.

A further object of the present invention is to provide an ink jet type recording head having nozzles arranged in a flat plane to substantially increase the nozzle density.

Another object of the present invention is to provide an ink jet type recording head having nozzles arranged in a matrix and having an ink supply system suitable for the matrix arrangement of nozzles.

Another object of the present invention is to provide an ink jet type recording head which is capable of increasing the number of nozzles without increasing the size of the head and of realizing a high speed printing by selectively using the nozzles.

The ink jet type recording head according to the present invention, which prints characters and/or drawings by selectively jetting ink droplets from a plurality of nozzles, is featured by a simple structure and an increased number of nozzles without increase of the size thereof.

That is, the ink jet type recording head according to the present invention is featured by comprising a nozzle plate formed in a front surface thereof with a plurality (n) of nozzles, an ink chamber plate arranged substantially in parallel to a rear surface of the nozzle plate and forming an ink pool therebetween, an outer partition wall arranged between the nozzle plate and the ink chamber plate liquid-tightly to define the ink pool, a plurality of discrete partition walls arranged between the nozzle plate and the ink chamber plate within the outer partition wall, each discrete partition wall defining a discrete space communicating with different one of the nozzles, an ink supply port formed in each of the discrete partition wall to supply ink from the ink pool to the discrete space defined thereby and pressure generation means for pressurizing ink supplied from the ink pool through the ink supply ports to the discrete spaces separately.

The ink chamber plate is formed from a thin plate member capable of propagating mechanical vibration in a thickness direction thereof. The pressure generation means preferably includes electro-mechanical transducer elements for separately giving mechanical force to ink in the discrete spaces communicating with the respective nozzles. In concrete, the pressure generation means may include heat-generating elements arranged within the respective discrete spaces and electric means for separately driving the heat generating elements.

Ink is supplied to the ink pool formed in the ink chamber plate and then from the ink pool through the ink supply ports of the respective discrete partition walls to the discrete spaces defined by the respective discrete partition walls and communicating with the respective nozzles. Ink supplied to the discrete spaces, which correspond to pressure chambers, are jetted from the nozzles arranged correspondingly to the discrete spaces, when pressure is exerted therein by the pressure generation means.

As the pressure generation means, electro-mechanical transducer elements such as piezo-actuators for producing mechanical force in response to an electrical signal may be used. With this pressure generation means, mechanical force is separately given externally of the ink chamber plate to the discrete spaces communicating with the nozzles. The ink chamber plate is formed from the thin plate member so that the mechanical force is sensitively propagated in the thickness direction thereof to exert pressure on ink supplied to the spaces in the ink chamber plate.

Alternatively, it is possible to arrange heat-generating elements in the respective discrete spaces as the pressure generation means. In such case, when the heat-generating elements generate heat selectively by the electric means, ink in the discrete spaces heated inflates and is jetted from the corresponding nozzles by the inflation force.

The outer partition wall and the discrete partition walls are integrated into one surface of either the ink chamber plate or the nozzle plate such that the discrete spaces communicating with the respective nozzles are defined within the ink pool. In such case, a plurality of the discrete partition walls corresponding to a plurality (for example, 8 rows×20 columns=160) of nozzles formed in the nozzle plate can be integrally formed as a unit. Therefore, the number of parts and the number of assembling steps can be substantially reduced, so that the head can be manufactured at low cost. Using an etching (chemical processing) or electroforming technology may achieve the integral machining of the partition walls.

Alternatively, a plurality of the outer partition walls each surrounding a plurality of the discrete partition walls, may be formed to form a plurality of independent ink pools. In such case, it is possible to fill the respective ink pools with ink having different colors so that a compact multi-color ink jet type recording head having a simple structure can be realized.

The nozzle plate is formed from a thick plate member and recesses having centers corresponding to centers of the respective nozzles are formed in a rear surface of the nozzle plate. With such recesses, stagnation and/or sluggishness of the flow of ink from the spaces to the nozzles is prevented. Further, when void is introduced in the discrete space in this structure, it is easily ejected from the corresponding nozzle.

Although a single ink supply port is provided for each of the discrete spaces defined by the respective partition walls, it is possible to provide a plurality of ink supply ports for each of the discrete spaces. For the case where each discrete space is formed with one ink supply port, an amplitude of a pressure wave propagating from the ink supply port back to the ink pool when a pressure is exerted on ink within the discrete space is small and it is possible to increase the amplitude of the pressure wave in the vicinity of the corresponding nozzle. Therefore, it is possible to efficiently jet an ink droplet. In the case where a plurality of ink supply ports are formed for each discrete space, refill of ink to the discrete space after an ink droplet is jetted can be performed smoothly although an amount of ink flowing from the ink supply port back to the ink pool when a pressure is exerted on ink within the discrete space is increased slightly. Therefore, it becomes possible to allow a high speed printing by increasing a driving frequency.

The ink supply port or ports may be formed by removing a portion or portions of the space partition wall and an orientation or orientations of the ink supply port or ports may be the same as or different from that or those of adjacent discrete spaces. In a case where the orientation or orientations of the ink supply ports are different from that or those of adjacent spaces, it is possible to reduce the sound cross talk with respect to other nozzles. Further, since mutual interference of ink flows to the ink supply ports, which occurs when ink is refilled from the ink pool to the discrete spaces, can be prevented, it is possible to improve the ink refill characteristics.

The plurality (n) of the nozzles may be arranged two-dimensionally in a matrix in a main scan direction and a sub scan direction. Further, it may be possible to arrange them at a predetermined angle a with respect to the main scan direction. With such arrangement of the nozzles, there is no overlapping of the nozzle positions in the sub scan direction and, therefore, it becomes possible to print by simultaneously driving all nozzles.

As mentioned, since the head structure of the present invention is essentially composed of the two parts, the nozzle plate and the ink chamber plate, the structure becomes very simple. Therefore, the ink jet type recording head according to the present invention can be manufactured at low cost with reduced number of manufacturing steps. Further, the nozzles can be arranged two-dimensionally, high freedom of the nozzle layout can be obtained and it is possible to reduce the restriction of the position and the number of the ink supply ports. Further, it is possible to increase the number of nozzles to thereby enable a high-speed printing.

Since the region defined by the nozzle plate, the ink chamber plate and the outer partition wall is used as the ink pool for reserving ink and the discrete spaces, that is, the discrete pressure chambers, are formed within the ink pool, it is possible to make the recording head compact and to provide the ink pool having sufficiently large capacity. Further, it is possible to realize a stable jetting of ink droplets even when a plurality of nozzles are driven simultaneously regardless of the number of the nozzles.

BRIEF DESCRIPTION OF THE DRAWINGS

The present invention will be described in detail with reference to the accompanying drawings, in which.

DETAILED DESCRIPTION OF THE PREFERRED EMBODIMENTS

Figure 7:
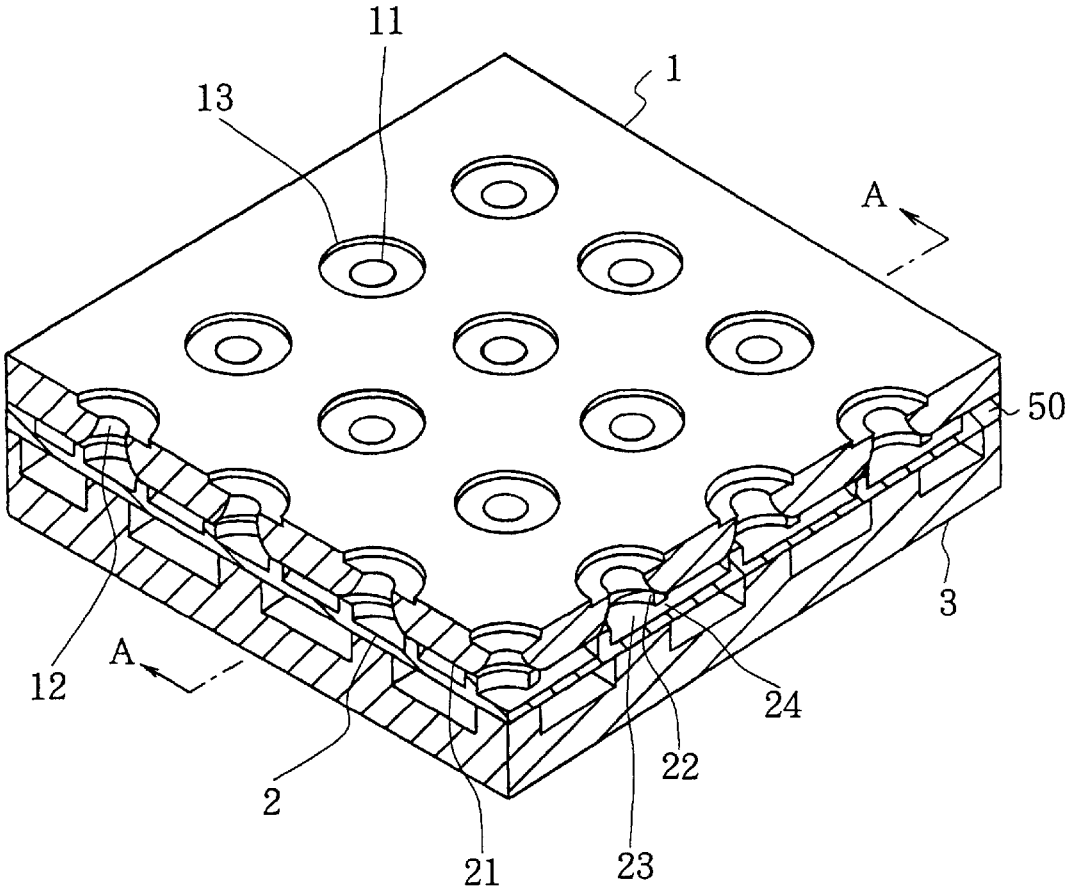
FIG. 7 is a partially cross sectioned perspective view of an ink jet type recording head according to a first embodiment of the present invention.
Figure 8:
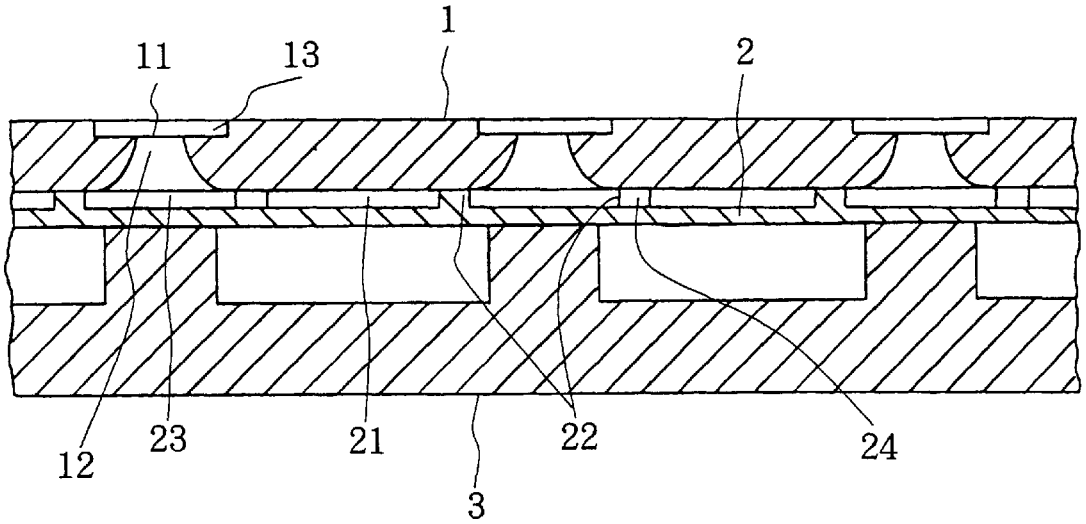
FIG. 8 is a partially enlarged cross section taken along a line A—A in FIG. 7.
Figure 9:
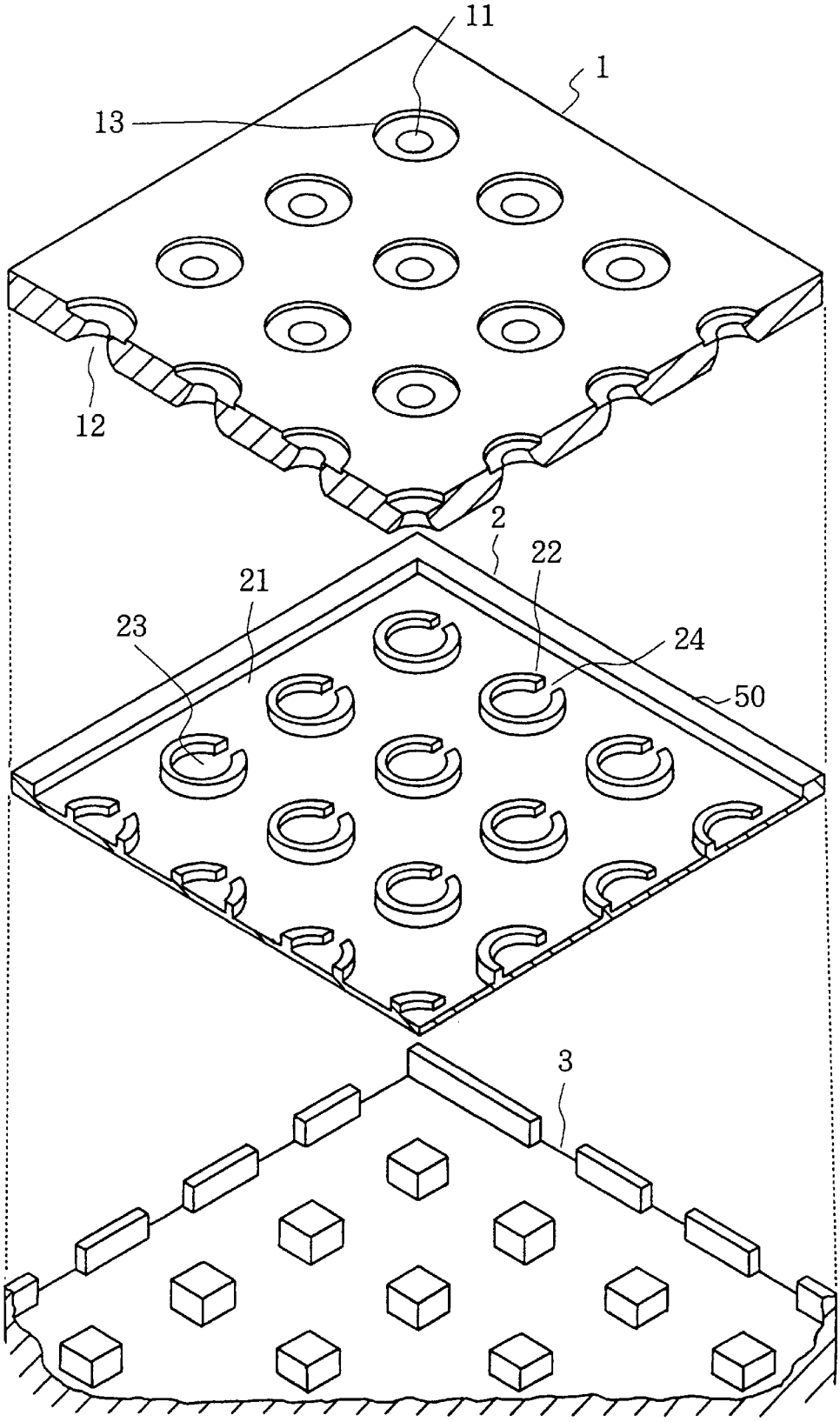
FIG. 9 is a partially cut away, disassembled perspective view of the structure shown in FIG. 7.

FIG. 7 is a partially cross sectioned perspective view of an ink jet type recording head according to a first embodiment of the present invention, FIG. 8 is a partially enlarged cross section taken along a line A—A in FIG. 7 and FIG. 9 is a partially cut away, disassembled perspective view of the structure shown in FIG. 7.

The first embodiment of the present invention shown in FIGS. 7 to 9 comprises a nozzle plate 1 having a surface in which a plurality (for example, 8×8=64) of nozzles 11 are arranged, an ink chamber plate 2 arranged substantially in parallel to a rear surface of the nozzle plate 1 and providing an ink pool 21 to which ink is supplied externally, discrete space partition walls 22 provided between the nozzle plate 1 and the ink chamber plate 2 in contact therewith for defining discrete spaces 23 communicating with the respective nozzles 11, an outer partition wall 50 provided between outer peripheries of the nozzle plate 1 and the ink chamber plate 2 in contact therewith for defining the ink pool 21, ink supply ports 24 formed in the respective space partition walls 22 for supplying ink from the ink pool 21 to the discrete spaces 23 and pressure generation means 3 for separately pressurizing ink in the discrete spaces 23. In the first embodiment, a diameter of the nozzle is 30 μm, a thickness of the nozzle plate is 100 μm and a nozzle pitch is 1.0 mm.

The ink chamber plate 2 is formed from a thin plate member which can propagate mechanical vibration in a thickness direction thereof and the pressure generation means 3 includes electro-mechanical transducer elements which are capable of separately pressurizing the ink in the discrete spaces 23, and which are located externally of the ink chamber plate 2.

The space partition walls 22 having a ring-shape (FIGS. 10 and 11) or a square-shape (FIGS. 12 to 14) in plan view are formed, together with the outer partition wall 50, integrally with the ink chamber plate 2 by electroforming using Ni. Heights of the space partition walls 22 and the outer partition wall 50 defining the ink pool 21 are commonly 70 μm. In the case where the space partition wall 22 has the ring-shape, an inner diameter thereof is 0.6 mm and, in the case where the space partition wall 22 has the square-shape, a length of each side thereof is 0.6 mm. Thickness of the ink chamber plate 2 is 25 μm. The nozzle plate 1 is formed to a thickness of 100 μm by the electroforming of Ni and bell-shaped spaces 12 having centers coincident with those of the respective nozzles 11 and communicating with the respective nozzles 11 are formed in a read surface of the nozzle plate 1. In the first embodiment, since the nozzle plate 1 is formed by the electroforming, circular recesses 13 having centers coincident with those of the respective nozzles 11 are formed in the ink jetting side surface of the nozzle plate 1.

Figure 10:
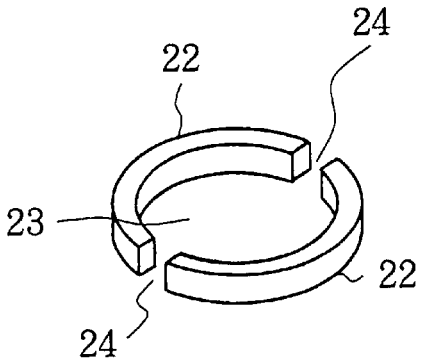
FIGS. 10 and 11 are perspective views showing examples of an arrangement of ink supply ports provided in ring-shaped space partition walls in the first embodiment, respectively.
Figure 11:
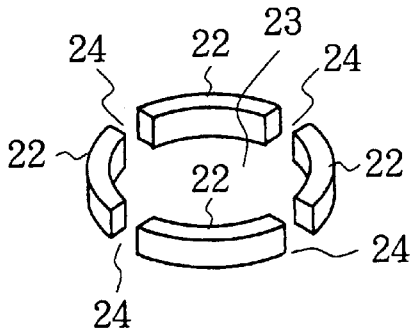
Figure 12:
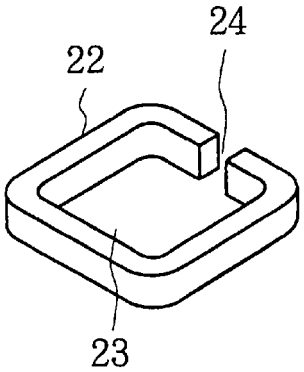
FIGS. 12 to 14 are perspective views showing examples of an arrangement of ink supply ports provided in square-shaped space partition walls in the first embodiment, respectively.
Figure 13:
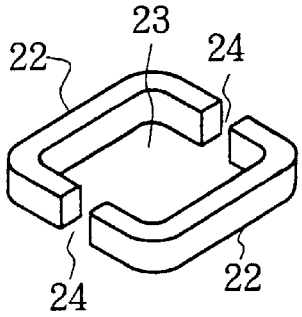
Figure 14:
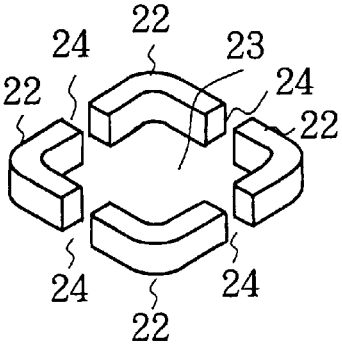

The ink supply port or ports 24 are formed for each discrete space 23 by notching or cutting the space partition wall 22 thereof partially. For example, one ink supply port 24 may be formed in each space partition wall as shown in FIGS. 9 and 12, two ink supply ports 24 may be formed as shown in FIGS. 10 and 13 or four ink supply ports may be formed as shown in FIGS. 11 and 14. That is, the number of the ink supply ports to be formed for each discrete space 23 can be arbitrarily selected according to the design condition. Incidentally, in this embodiment, the notches or cut-away portions of the discrete space partition wall 22 were formed by patterning the nozzle plate 1 when the nozzle plate 1 is formed by electroforming. In this example, width of the notch or cut-away portion is 20 μm.

The nozzles 11 are arranged two-dimensionally in the main scan direction and the sub scan direction, for example, in a matrix. As the electro-mechanical transducer element of the pressure generation means 3, a piezo-actuator may be used, for example.

In the ink jet type recording head according to the first embodiment of the present invention, when ink is supplied from an ink reservoir (not shown) into the ink pool 21, it is introduced through the ink supply ports 24 into the discrete spaces 23 and the bell-shaped spaces 12 and reserved therein. Then, when an electric signal is supplied to the pressure generation means 3 according to a picture data supplied from a drive control circuit (not shown), the pressure generation means 3 generate mechanical force according to the electric signal. Therefore, a pressure wave corresponding to the mechanical force is generated in ink in the discrete spaces 23, so that ink droplets are jetted from the nozzles 11. Due to restoring force of once retreated ink meniscus in the nozzles after the ink droplets are jetted, the discrete spaces 23 are refilled with ink from the ink pool 21 through the ink supply ports 24.

Due to the existence of the bell-shaped spaces 12 having the centers coincident with the centers of the respective nozzles 11 in the nozzle plate 1, it is possible to refill the discrete spaces 23 with ink from the ink pool 21 through the ink supply ports 24 smoothly without stagnation, convection and/or vortex. It has been confirmed by experiments that, even if void is introduced into the bell-shaped space 12, the void can be easily excluded by ion adsorption operation performed from the side of the nozzle 11.

The ink jet type recording head according to the present invention can be basically constructed with two parts, the nozzle plate 1 and the ink chamber plate 2. Therefore, its structure is very simple.

The recording head of the present invention was assembled by adhering the nozzle plate 1 to the ink chamber plate 2 by means of an adhesive. Describing the adhering of the nozzle plate 1 and the ink chamber plate 2, the shape of the ink supply port and the relative positional relation of the ink supply port with respect to the ink pool 21 and the discrete space 23 are not influenced by the accuracy of lamination of the nozzle plate 1 and the ink chamber plate 2. Therefore, even if the ink chamber plate 2 and the nozzle plate 1 are adhered to each other without high accuracy, the ink refilling characteristics and the ink jetting characteristics are not influenced by such rough positioning. That is, even if the ink chamber plate 2 is not precisely laminated on the nozzle plate 1, there may be a mere relative deviation between the bell-shaped space 23 and the discrete space 21 and a total ink capacity of the bell-shaped space 23 and the discrete space 21 is not changed at all. Consequently, the unique period of the pressure wave generated when a pressure is applied to ink within the bell-shaped space 23 by the pressure generation means 3 is unchanged and does not influence the ink droplet jetting characteristics of the nozzle.

The following experiment was conducted to study the influence of the positional error of lamination. That is, the recording heads having the nozzle plate 1 and the ink chamber plate 2 with lamination error of 5 μm and of 50 μm with other conditions being the same were manufactured and the ink droplet jetting characteristics thereof were measured. There was no difference observed in the diameter of jetted droplet and in the jetting speed of ink droplet between the two recording heads.

Figure 1:
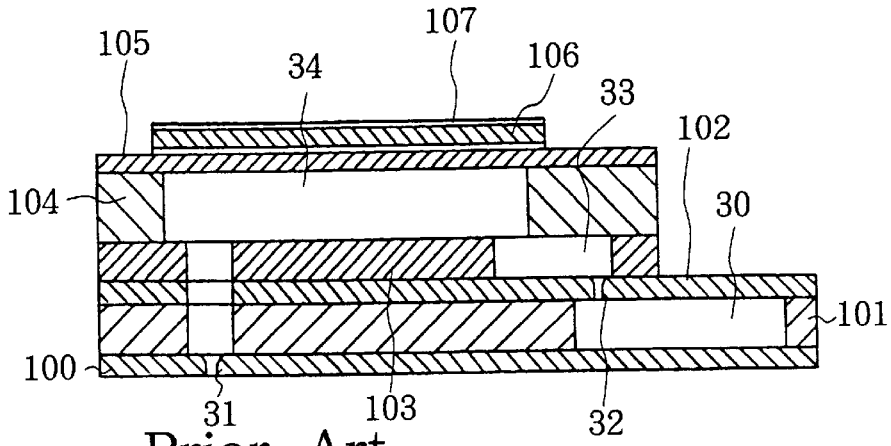
Prior Art FIG.1
FIG. 1 shows an example of a prior art structure of an ink jet type recording head in an enlarged cross section.
Figure 2:
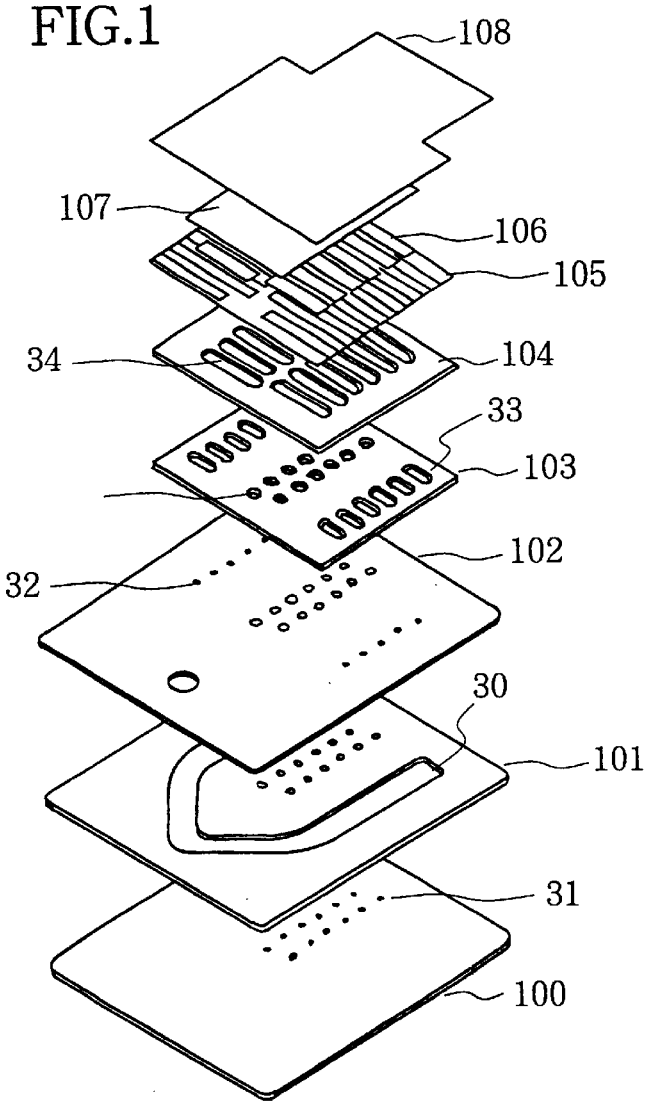
Prior Art FIG.2
FIG. 2 is a disassembled perspective view of the ink jet type recording head shown in FIG. 1.
Figure 3:
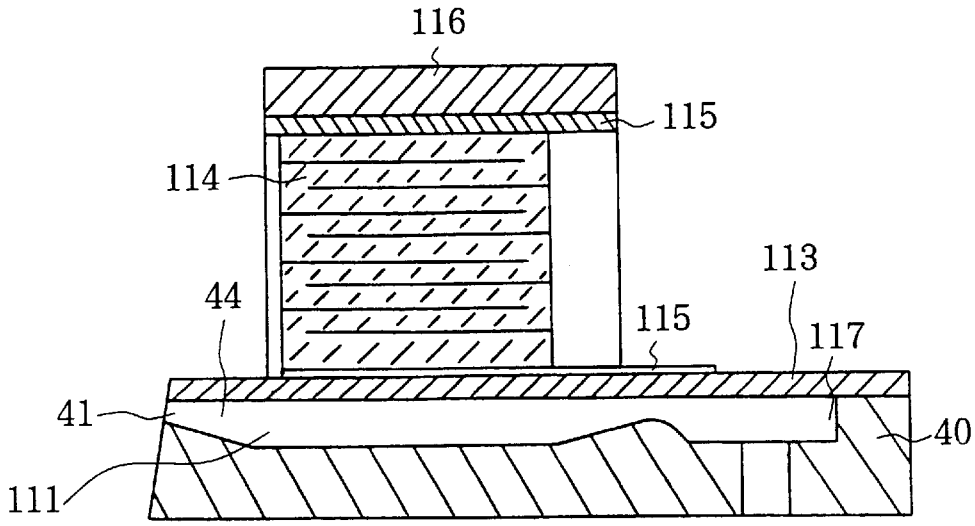
Prior Art FIG.3
FIG. 3 shows another example of a prior art structure of an ink jet type recording head in an enlarged cross section.
Figure 4:
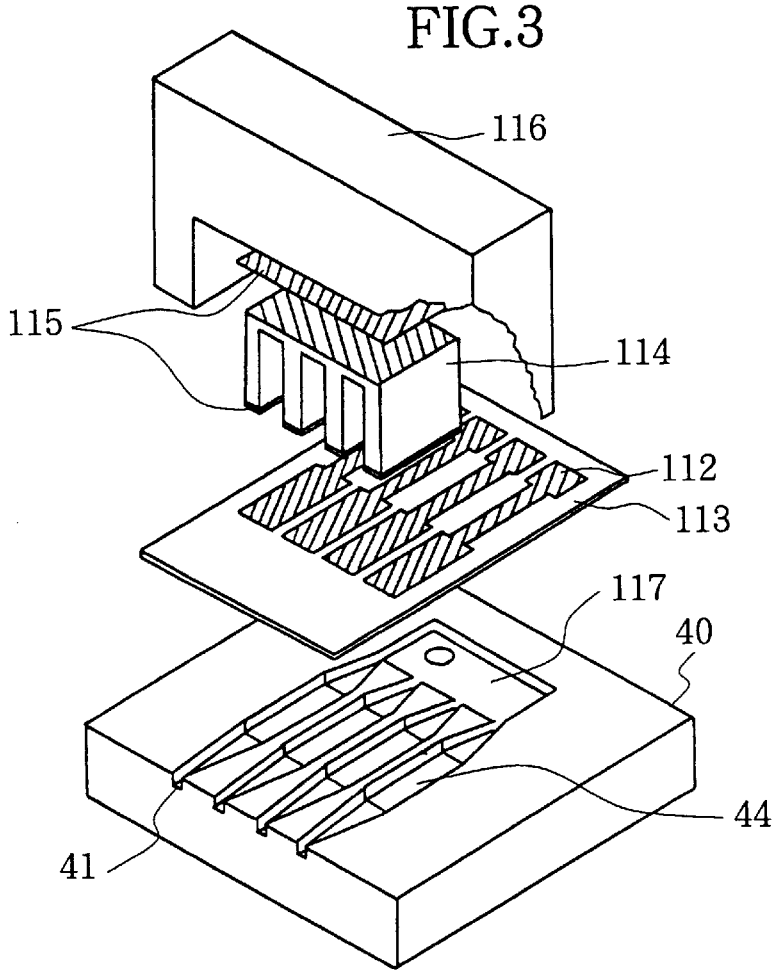
Prior Art FIG.4
FIG. 4 is a disassembled perspective view of the ink jet type recording head shown in FIG. 3.
Figure 5:
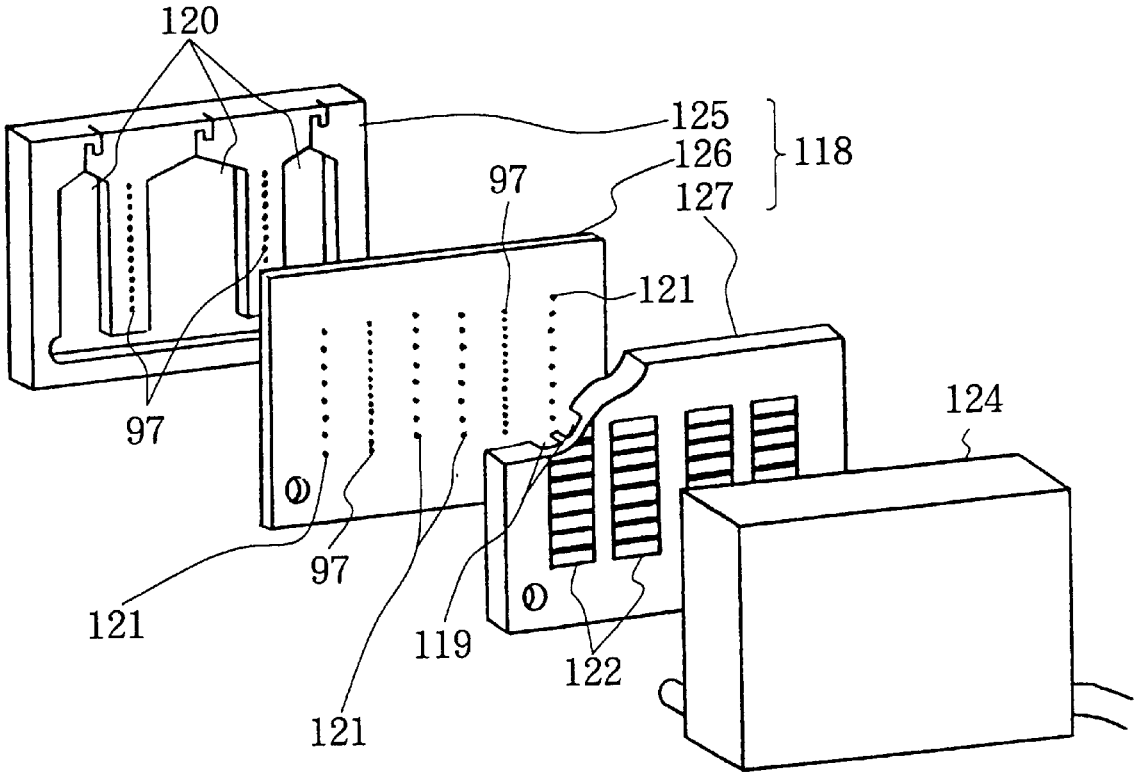
Prior Art FIG.5
FIG. 5 is a disassembled perspective view of another example of a prior art structure of an ink jet type recording head.
Figure 6:
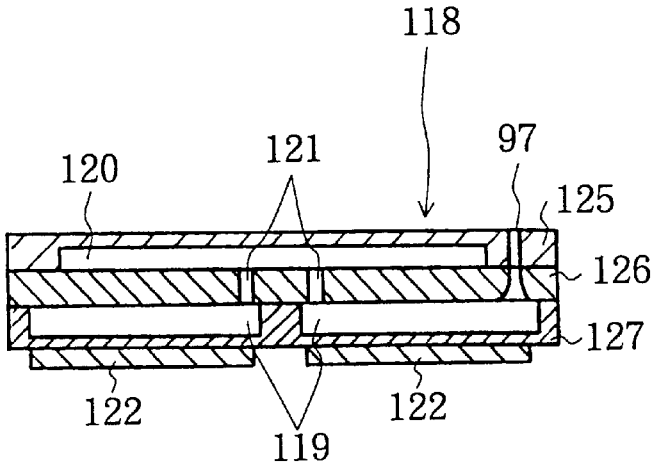
Prior Art FIG.6
FIG. 6 is an enlarged cross section of the ink jet type recording head shown in FIG. 5.

In this regard, the merit of this embodiment of the present invention will be described in comparison with the prior art structure shown in FIGS. 1 and 2. In the prior art structure shown in FIGS. 1 and 2, when the reservoir chamber forming plate 101 is laminated with the ink supply port forming plate 102 with positional error between them, the position of the ink supply port 32 with respect to the ink pool 30 is changed by a distance corresponding to the error. If the ink supply port 32 is covered by the reservoir forming chamber plate 101 even partially, the refill characteristics of ink after ink droplet is jetted is substantially changed so that it becomes impossible to jet ink droplet at a desired driving frequency. Although the ink supply port is formed in a desired position in the vicinity of the outer peripheral portion of the ink pool which is desirable in order to discharge void if the void is mixed in the ink pool for some reason, the discharge of void may be adversely influenced by the positional error between the ink supply port and the ink pool. Further, due to such positional error, step portions may be formed in the nozzle communication passages formed on the side of the nozzle 31. For example, if void is mixed in a recessed portion of the step, it is difficult to discharge the void.

That is, even if the positional error between the plates is small, the ink jetting characteristics and the reliability of the recording head are immediately influenced thereby. In the structure shown in FIGS. 1 and 2, the positional error between the plates 101 and 102 must be controlled to 20 to 30 μm or less.

In the present invention, since it is possible to form the discrete spaces 23 in the ink pool 21 by the space partition walls 22, it becomes possible to set the positions and the number of the nozzles 11 and the ink supply ports 24 arbitrarily and it is possible to realize a compact recording head having high nozzle density by arranging the nozzles in a matrix, for example.

Further, since other region than the discrete spaces 23 each surrounded by the space partition wall 22 can be used as the ink pool 21, it is possible to make the capacity of the ink pool large in the compact recording head. Therefore, it is possible to prevent the jetting of ink droplet from becoming unstable due to sound cross talk between adjacent nozzles, which may occur when the capacity of the ink pool is small. Further, since it is possible to prevent a shortage of ink supply to the pressure chambers due to a shortage of capacity of ink pool when all of the nozzles are driven simultaneously, it is possible to realize a stable ink droplet jetting regardless of the number of nozzles to be driven.

The fact that a sufficient capacity of the ink pool is provided and a number of nozzles can be driven simultaneously was confirmed by the following experiment. That is, a diameter and a droplet speed of a droplet jetted were measured when one of the nozzles of the ink jet type recording head having 64 nozzles is driven and when 64 nozzles are driven simultaneously. A result is as follow:

| | diameter of ink droplet (μm) | droplet speed (m/s) |
|---|---|---|
| 1 nozzle driven | 40.0 | 8.0 |
| 64 nozzles driven | 40.5 | 8.5 |

In the case where 64 nozzles are driven simultaneously, the diameter of ink droplet and the droplet speed were measured while changing the driving frequency from 1 Hz to 10 kHz. A result was that the diameter of the droplet was 40±0.5 μm and the droplet speed was 8±0.5 m/s. In this example, the nozzle plate 1 was formed by the electroforming.

Another sample of the nozzle plate 1 was formed by the micro-press method. In this case, the nozzle 11 and the bell-shaped space 12 had truncated corn shapes, the nozzle diameter was 30 μm, an inner diameter of a bottom of the bell-shaped space 12 was 60 μm and the recess 13 was not formed. Using this nozzle plate performed similar experiment and it was confirmed that there is no considerable difference between the cases where only one nozzle is driven and where 64 nozzles are driven simultaneously.

Figure 15:
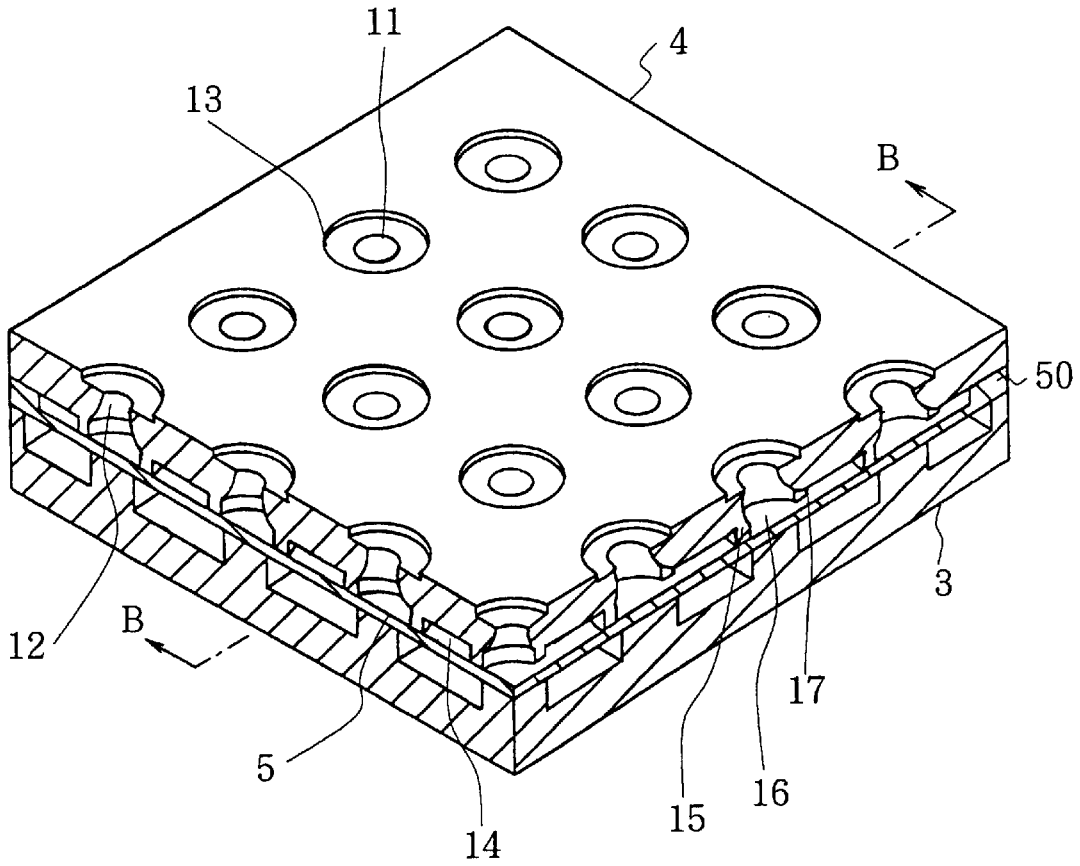
FIG. 15 is a partially cut away, perspective view of a structure according to a second embodiment of the present invention.
Figure 16:
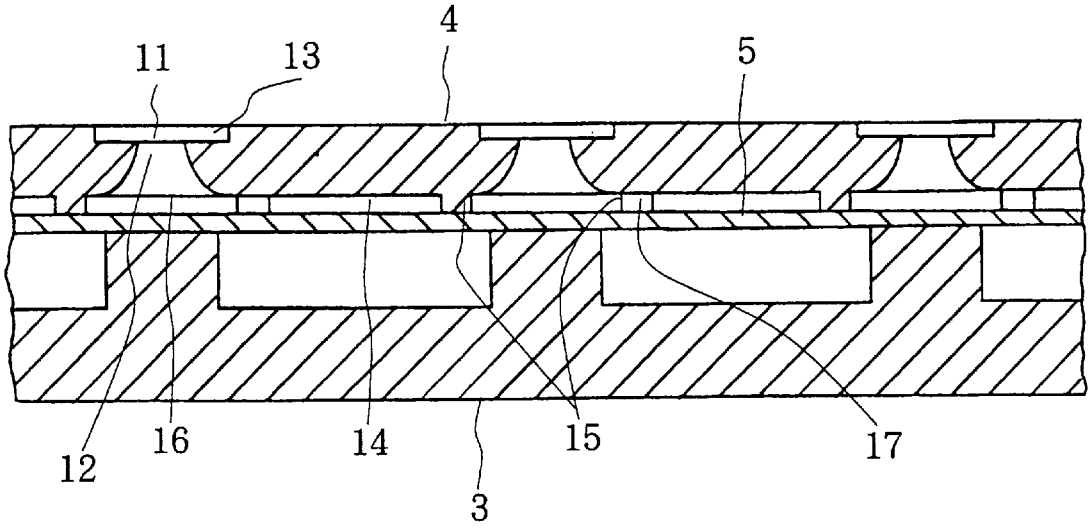
FIG. 16 is a partially enlarged cross section taken along a line B—B in FIG. 15.
Figure 17:
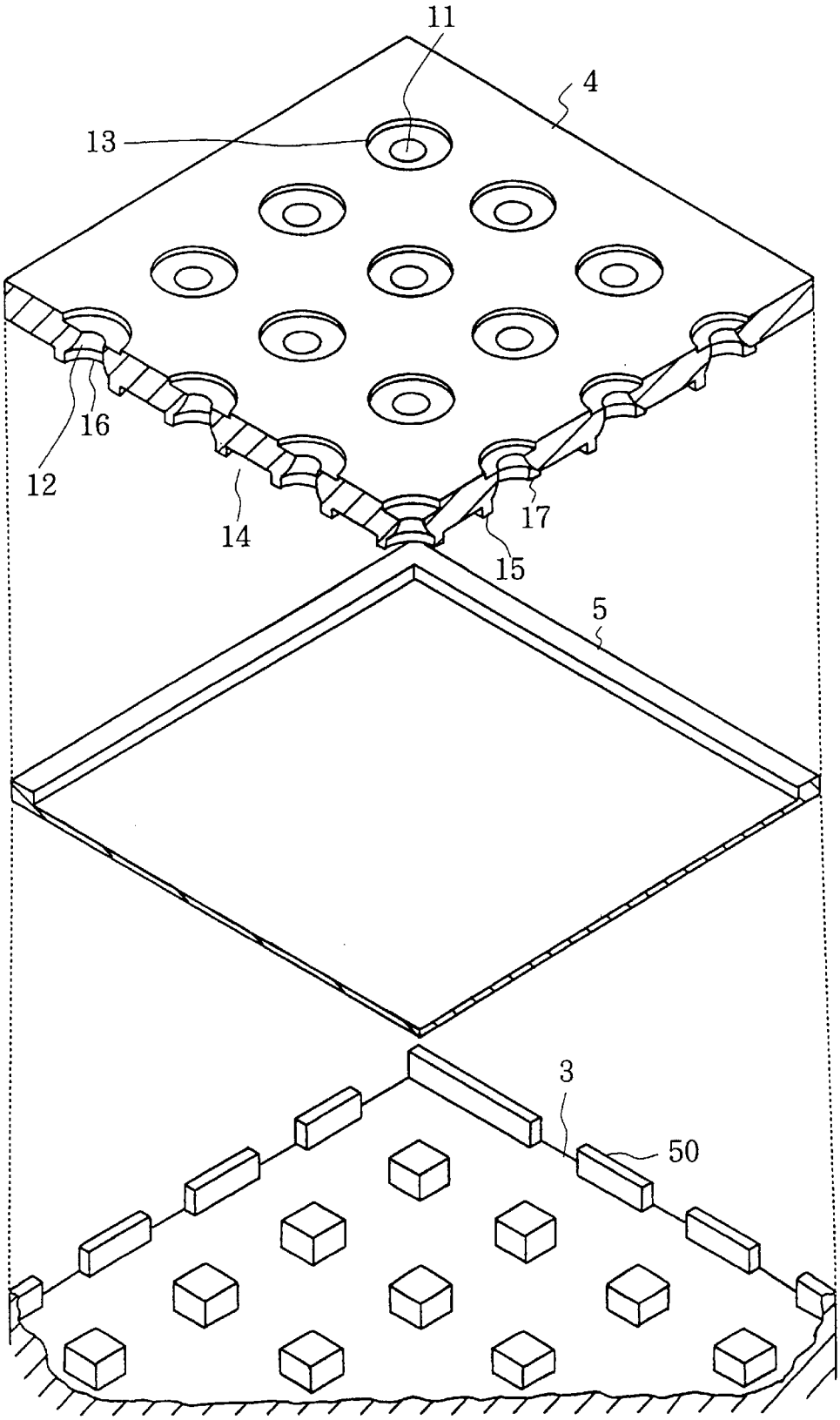
FIG. 17 is a disassembled perspective view of the second embodiment.

FIG. 15 is a partially cut away, perspective view of a structure according to a second embodiment of the present invention, FIG. 16 is a partially enlarged cross section taken along a line B—B in FIG. 15 and FIG. 17 is a disassembled (exploded) perspective view of the second embodiment.

This embodiment comprises a nozzle plate 4, an ink chamber plate 5 arranged in substantially parallel to the nozzle plate 4 and forming an ink pool 14 to which ink is supplied and pressure generation means 3 for providing a mechanical force to the ink chamber plate 5. In this second embodiment, the ink chamber plate 5 was formed by a polyimide resin film 50 μm thick.

The nozzle plate 4 has a surface in which a plurality (n) of nozzles 11, are formed and discrete partition walls 15 in contact with the ink chamber plate 5 for defining discrete spaces 16 communicating with the respective nozzles 11 in a rear side surface of the nozzle plate 4. Ink supply ports 17 each for supplying ink to a corresponding discrete space 16 are formed in the discrete partition walls 15. The nozzle plate 4 was integrally formed by electroforming. In this second embodiment, 8×16=128 nozzles 11 are arranged in a matrix in the nozzle plate 4. The shape of the discrete partition wall 22 and the number of the ink supply ports 17 formed in the discrete partition wall 22 are the same as those of the first embodiments shown in FIG. 7 and FIGS. 10 to 14.

Figure 18:
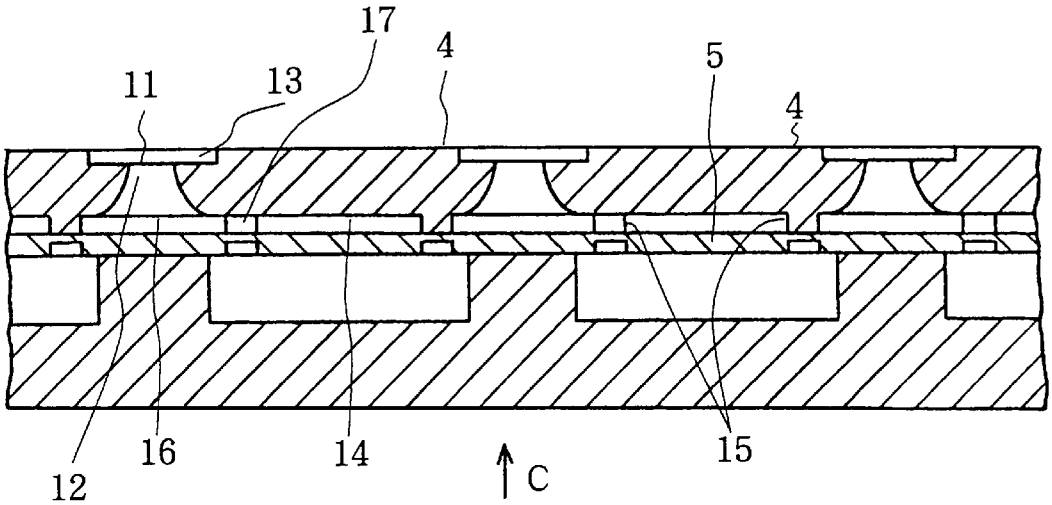
FIG. 18 is a partially enlarged cross section of the second embodiment when an ink chamber plate having locally changed thickness is used.
Figure 19:
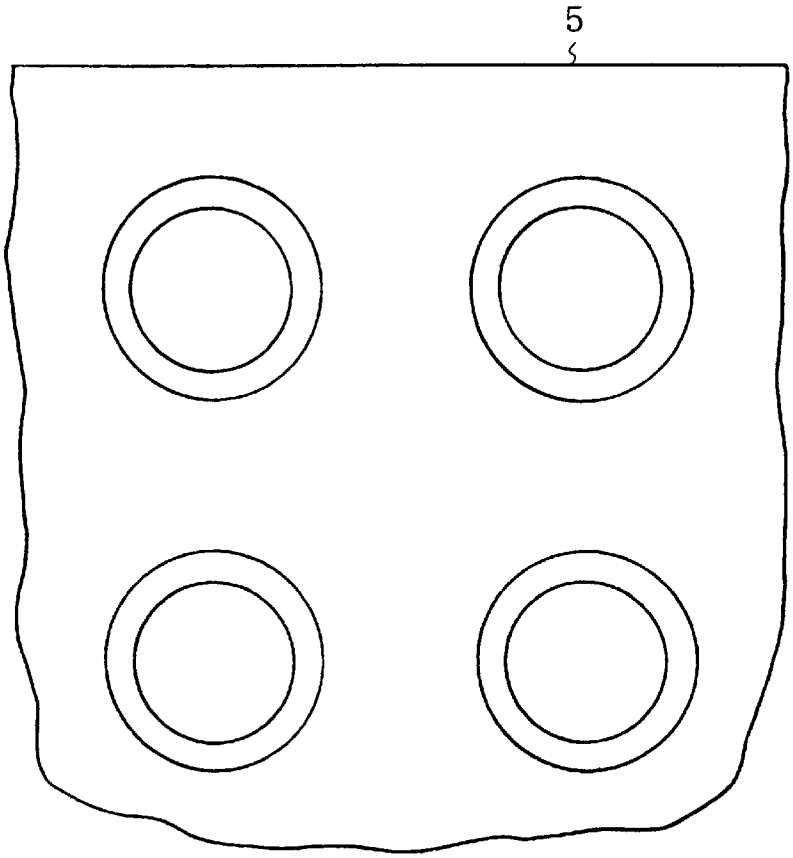
FIG. 19 is a bottom view of the ink chamber plate looked in a direction shown by an arrow C.

Incidentally, the thickness of the thin ink chamber plate 2 of the first embodiment or the polyimide resin film ink chamber plate 5 of the second embodiment is not always uniform. The thickness of the ink chamber plate 2 or 5 may be reduced at portions thereof which contact with the pressure generation means 3 as shown in FIGS. 18 and 19. FIG. 18 is a partially enlarged cross section of the second embodiment when an ink chamber plate having locally changed thickness is used and FIG. 19 is a bottom view of the ink chamber plate looked in a direction shown by an arrow C. In FIGS. 18 and 19, the ink chamber plate was formed by elecroforming of Ni such that the thickness thereof becomes generally 30 μm and the reduced thickness thereof becomes 10 μm.

Figure 20:
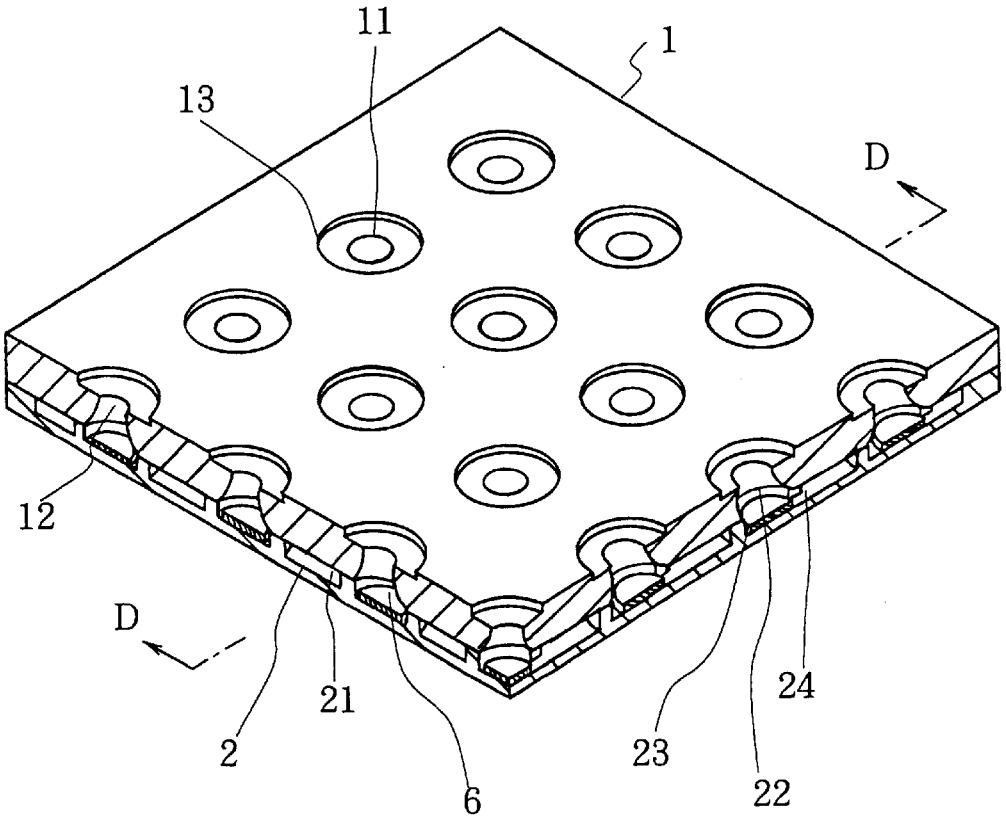
FIG. 20 is a partially cross-sectioned perspective view of a third embodiment of the present invention.
Figure 21:
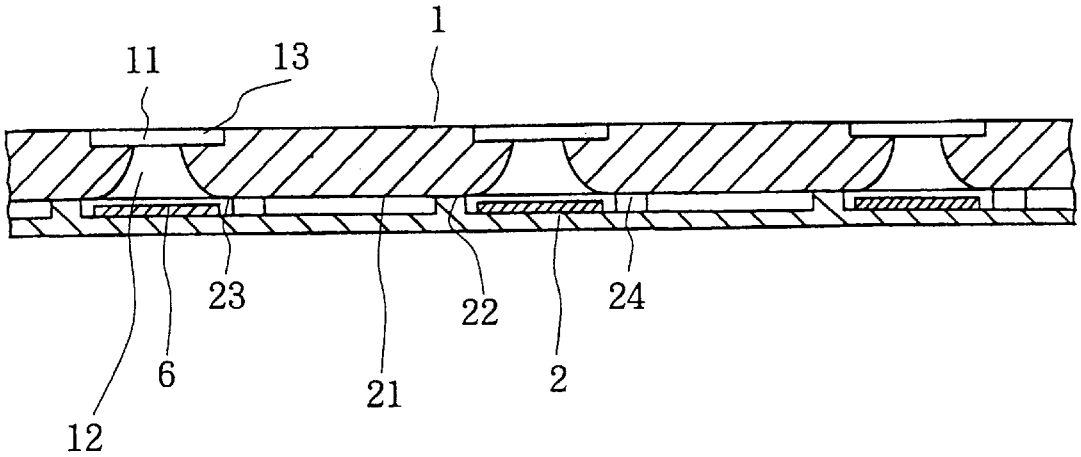
FIG. 21 is an enlarged cross section taken along a line D—D in FIG. 20.

FIG. 20 is a partially cross-sectioned perspective view of a third embodiment of the present invention and FIG. 21 is an enlarged cross section taken along a line D—D in FIG. 20.

The third embodiment includes, as the pressure generation means of the first embodiment, heat generating elements 6 arranged in respective discrete spaces 23 and electric means (not shown) for driving the heat generating elements 6. Other portions than this are the same as those of the first embodiment. This can also be applied to the second embodiment.

In the case of the third embodiment, a portion of ink in the discrete space 23 is evaporated and expanded and ink droplet is jetted by this expansion of ink. The refilling of ink to the discrete space 23 is performed from the ink pool similarly to the first embodiment.

Figure 22:
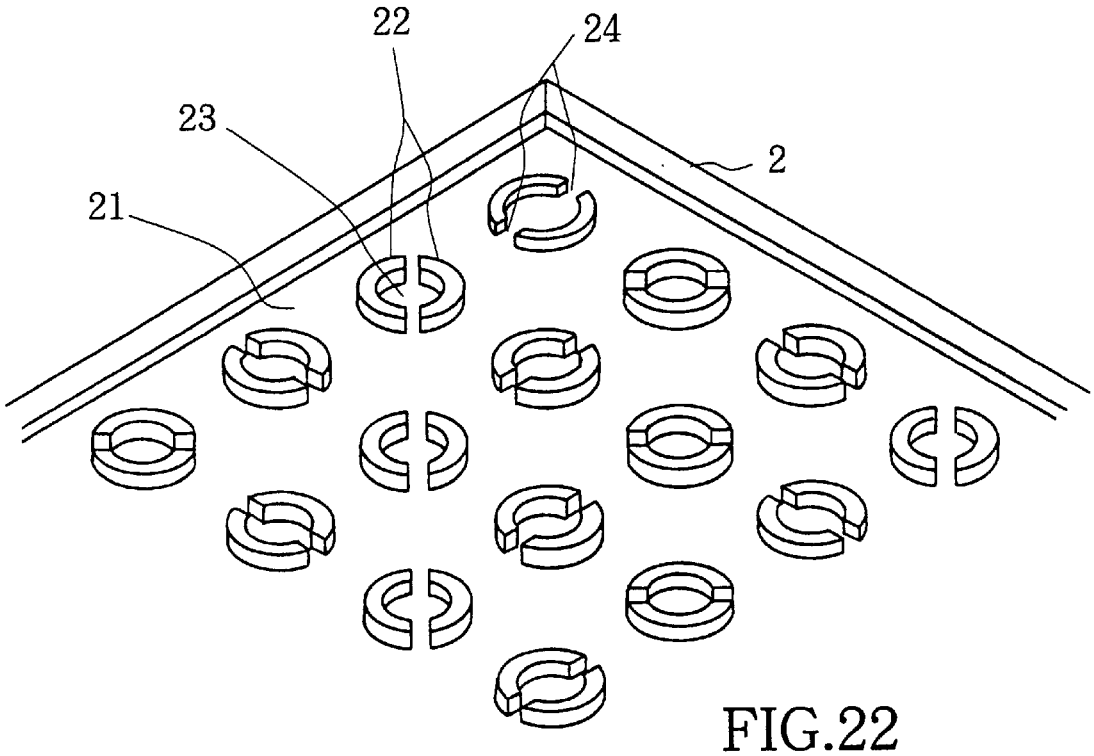
FIGS. 22 and 23 are partial cross sections showing arrangements of ink supply ports in a fourth embodiment of the present invention, respectively.
Figure 23:
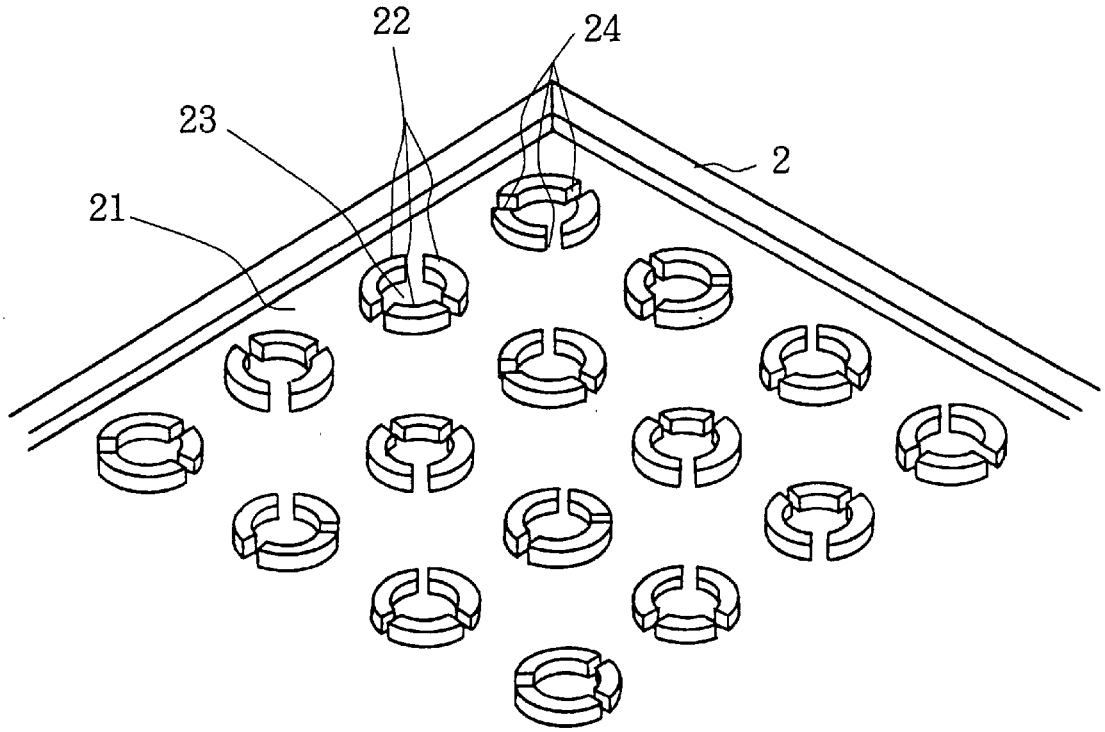

FIGS. 22 and 23 are partial perspective views showing an arrangement of ink supply ports in a fourth embodiment, in which FIG. 22 shows a case where two ink supply ports are formed in a discrete partition wall and FIG. 23 shows a case where three ink supply ports are formed in a discrete partition wall.

In this embodiment, the orientation of the ink supply ports 24 is different from that of adjacent ink supply ports 24. With such orientation of the ink supply ports, it is possible to restrict the sound cross talk which occurs when a plurality of nozzles are driven simultaneously. Further, with such orientation of the ink supply ports, mutual interference of ink flows from the ink pool 21 to the ink supply ports 24 between a plurality of space partition walls 22 after the discrete spaces 23 are refilled with ink is prevented. Such improvement of the ink refilling characteristics was confirmed by the following experiment.

Similarly to the first embodiment, a diameter and a speed of a droplet jetted were measured when one of the nozzles of the ink jet type recording head having 64 nozzles is driven and when 64 nozzles are driven simultaneously. A result is that, when the number of nozzles to be driven simultaneously is changed from 1 to 64, the diameter of droplet is changed from 40 μm to 40.2 μm and the droplet speed is changed from 8.0 m/s to 8.2 m/s. That is, the fourth embodiment is more advantageous than the first embodiment in that the effect of sound cross talk reduction is larger. Further, it was confirmed that, comparing with the first embodiment, it is possible, in the fourth embodiment, to slightly increase the ink refilling speed from the ink pool 21 to the discrete spaces 23 and to increase the driving frequency by about 5 to 7%.

The arrangements of the ink supply ports 24 of the fourth embodiment can be applied to any of the first, second and third embodiments.

Figure 24:
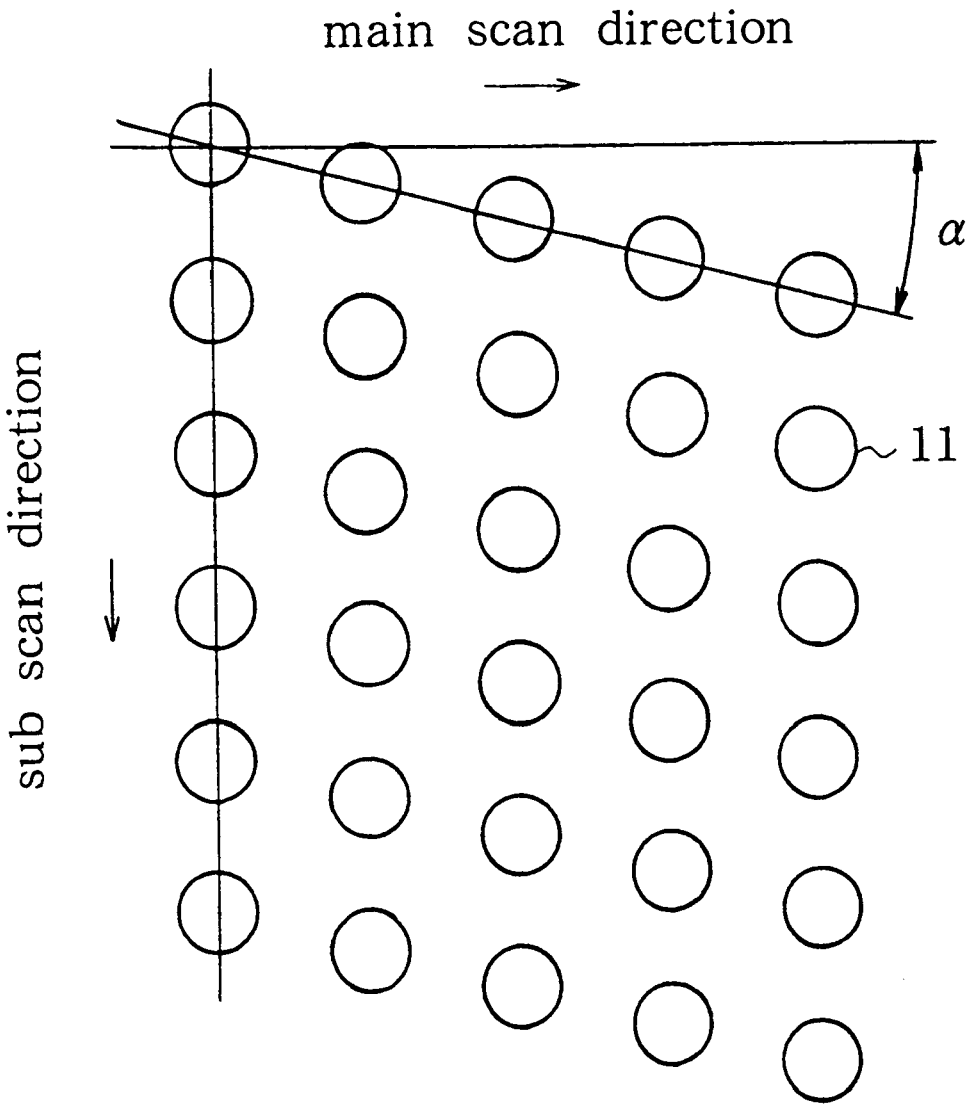
FIG. 24 is a plan view showing a nozzle arrangement in a fifth embodiment of the present invention.

FIG. 24 is a plan view showing a nozzle arrangement according to a fifth embodiment of the present invention.

In the fifth embodiment, a plurality (n) of nozzles 11 are arranged at a predetermined angle α with respect to a main scan direction. With such nozzle arrangement, it is possible to substantially increase the nozzle density in the main scan direction.

In the fifth embodiment, 8 nozzles are arranged in the main scan direction and 8 nozzles are arranged in the sub scan direction, totally 64 nozzles being provided. In order to avoid an overlapping of the 8 rows each including 8 nozzles to be arranged in the main scan direction and to arrange them with a constant pitch, the rows are arranged at an angle α with respect to the main scan direction. Although the pitch of the nozzles is 1 mm, it was possible to arrange the nozzles 11 in the sub scan direction with a pitch of substantially 125 μm.

The structure according to the fifth embodiment can be applied to the first, second, third and fourth embodiments.

Figure 25:
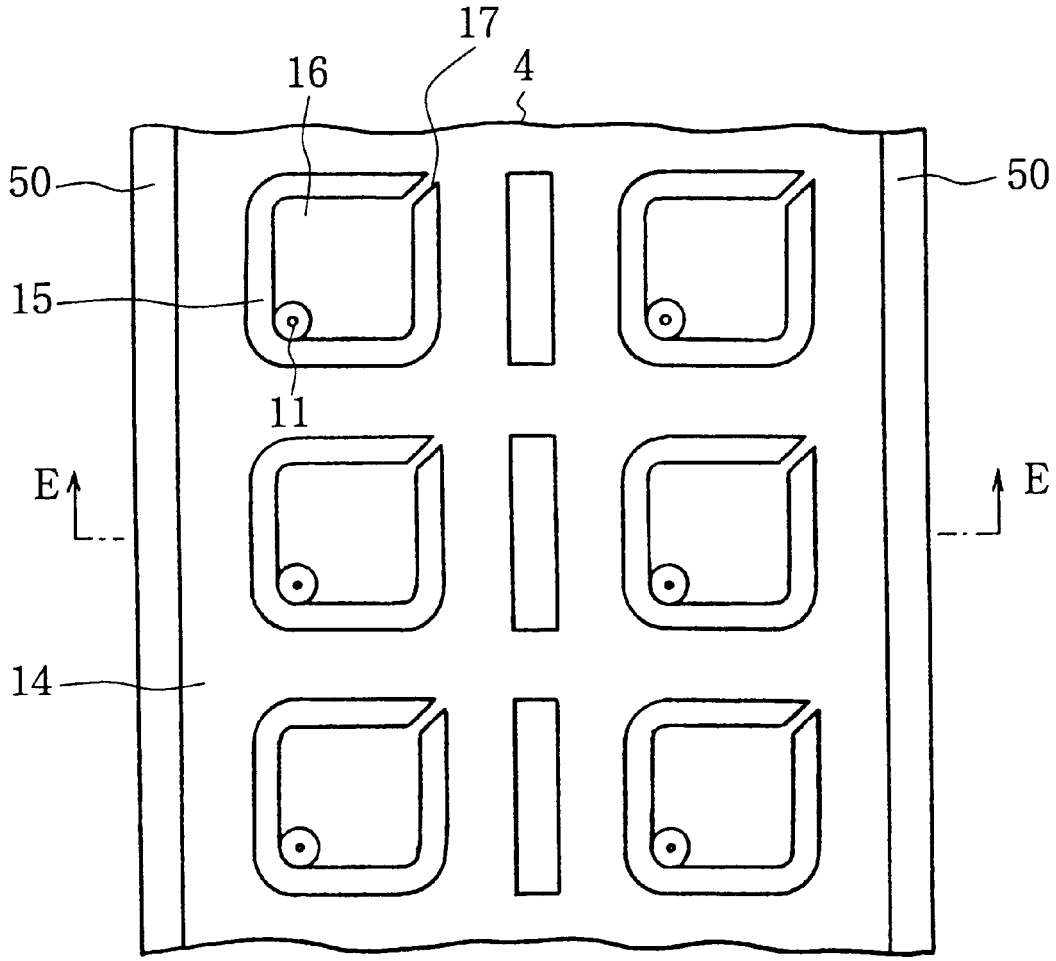
FIG. 25 is a back view of a nozzle plate used in a sixth embodiment of the present invention.
Figure 26:
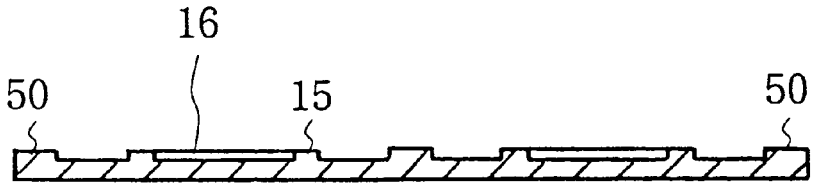
FIG. 26 is a cross section of the sixth embodiment taken along a line E—E in FIG. 25.
Figure 27:
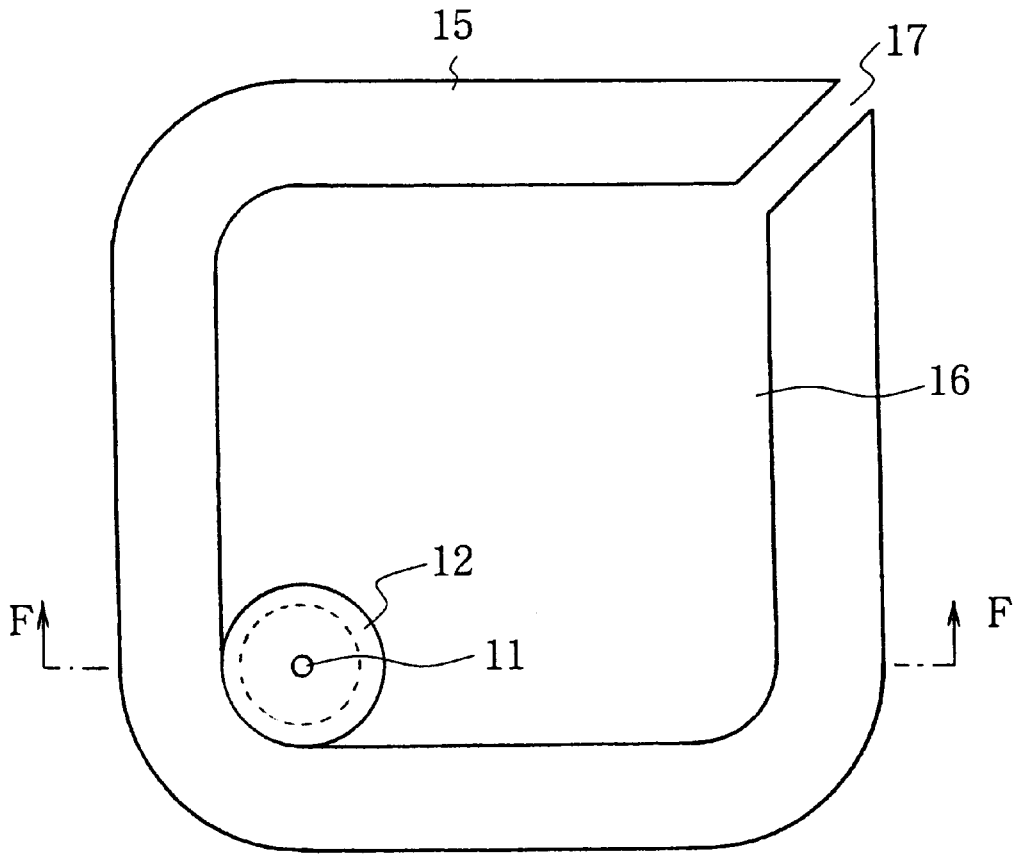
FIG. 27 is a partially enlarged back view of a nozzle plate used in the sixth embodiment of the present invention.
Figure 28:
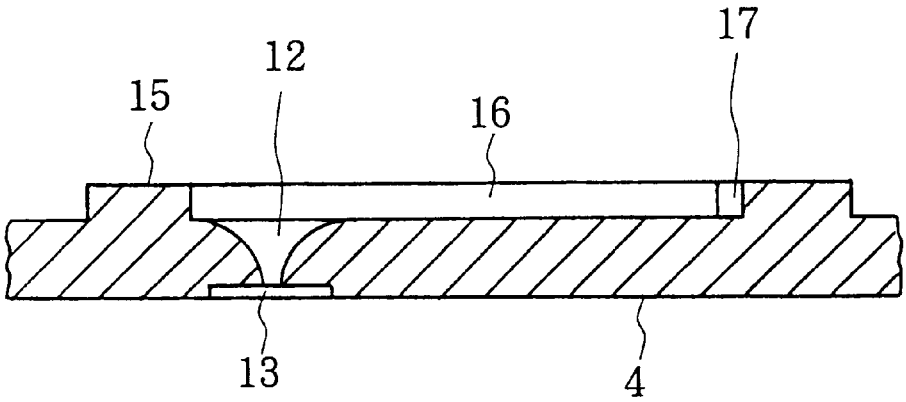
FIG. 28 is a partial cross section of the nozzle plate in a line F—F in FIG. 27.

FIG. 25 is a back view of a nozzle plate used in a sixth embodiment of the present invention, FIG. 26 is a cross section of the sixth embodiment taken along a line E—E in FIG. 25, FIG. 27 is a partially enlarged back view of a nozzle plate used in the sixth embodiment of the present invention and FIG. 28 is a partial cross section taken along a line F—F in FIG. 27.

The sixth embodiment shown in FIGS. 25 to 28 differs from the second embodiment shown in FIGS. 15 to 17 in that the center axis of each nozzle 11 formed in a nozzle plate 4 is eccentric from the center position of each discrete space 16, the discrete space 16 is defined by a square discrete partition wall 15 and each ink supply port 17 is arranged at one of four corners of each discrete partition wall 15. Other portions than this is the same as those of the second embodiment.

In the sixth embodiment, the discrete partition walls 15 and an outer partition wall 50 are formed from a dry film. First, the nozzle plate 4 was formed from a thin stainless steel plate 30 μm thick and, after the dry film is laminated on an upper surface of the nozzle plate 4, the discrete partition walls 15, the outer partition wall 50 and ink supply ports 17 were formed by patterning the dry film by using lithography. Then, the discrete partition walls 15, the outer partition wall 50 and the ink supply ports 17 were integrated to the nozzle plate 4 by pre-baking, an ink chamber plate 5 was overlapped on the nozzle plate 4, the nozzle plate 4 and the ink chamber plate 5 were bonded to each other by using adhesive nature of the dry film obtained by post-baking while they were in pressure contact with each other.

Although the sixth embodiment differs from the second embodiment in that the discrete partition walls 15 are formed from the dry film and the nozzle 11 deviates from the center of the discrete space 16, the basic construction of the sixth embodiment is the same as that of the second embodiment. That is, the operation for jetting ink supplied from the ink pool 14 and reserved in the discrete spaces 16 from the nozzle 11 when a pressure wave is applied to the ink in the discrete spaces 16 by the pressure generation means 3 shown in FIGS. 15 to 17 and the refilling operation for refilling ink to the discrete spaces 16 are performed similarly. According to experiments, it was confirmed that the ink flow is established adequately.

Although, in this embodiment, the discrete partition walls 15, the discrete spaces 16 and the ink supply ports 17 are formed in the nozzle plate 4, it may be possible to form them in the ink chamber plate 2 as in the case of the first embodiment. In such case, substantially the same effect can be obtained.

Figure 29:
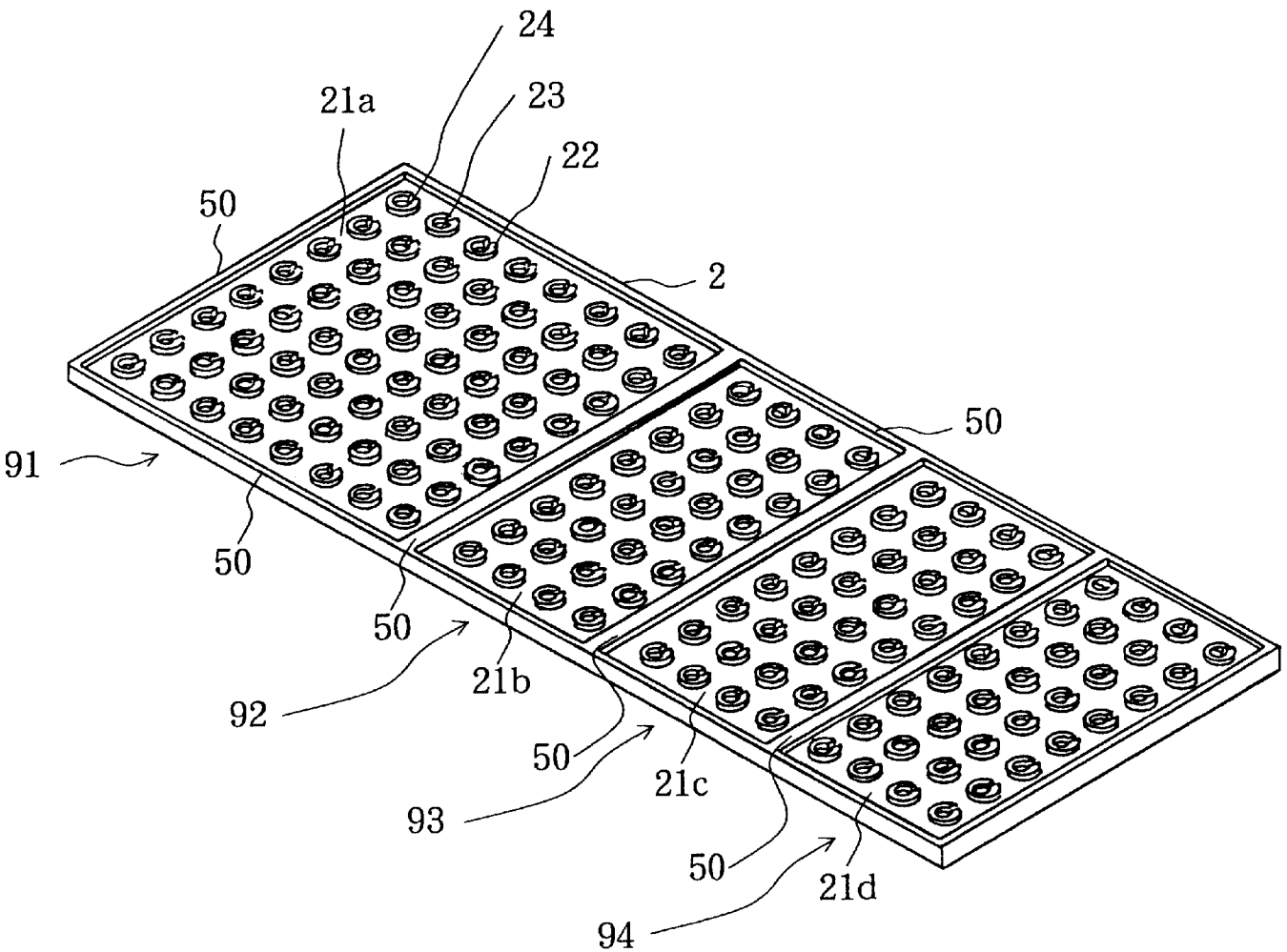
FIG. 29 is a perspective view showing a construction of an ink chamber plate used in a seventh embodiment of the present invention.

FIG. 29 is a perspective view showing a construction of an ink chamber plate according to a seventh embodiment of the present invention.

The seventh embodiment shown in FIG. 29 is used to constitute an ink jet type recording head for a multicolor printing and is basically the same as the first embodiment. 160 nozzles 11 are arranged in a nozzle plate 1 similar to that of the first embodiment. These nozzles 11 are divided to four blocks, a first block 91, a second block 92, a third block 93 and a fourth block 94. The first block 91 includes 8×8=64 nozzles 11 and each of the second, third and fourth blocks 92, 93 and 94 includes 8×4=32 nozzles 11. Discrete partition walls 22, discrete spaces 23 and ink supply ports 24 are formed correspondingly to the respective nozzles 11 and ink pools 21*a*, 21*b*, 21*c* and 21*d* are defined for the respective blocks 91 to 94 by outer partition walls 50.

The discrete partition walls 22, the discrete spaces 23, the ink supply ports 24 and the outer partition walls 50 are formed integrally with the ink chamber plate 2 by electroforming. Experiments were performed by filling the ink pool 21*a* with black ink, the ink pool 21*b* with yellow ink, the ink pool 21*c* with magenta ink and the ink pool 21*d* with cyan ink. It was confirmed that a printing can be done by jetting ink droplets having a plurality of colors filled in between the nozzle plate 1 and the ink chamber plate 2 and that a compact color ink jet type recording head can be formed by easily integrating the components.

For comparison purpose, four prior art color ink jet type recording heads filled with respective black ink, yellow ink, magenta ink and cyan ink were formed and the similar experiments were performed for these recording heads assembled as a single color recording head. Since a highly precise positioning is required for the relative positional relation of nozzles for the respective colors, a long time was consumed in order to position the four recording heads correctly. On the contrary, it was confirmed that, according to the seventh embodiment, it is possible to determine the relative positional relation of the nozzles 11 with high accuracy since the relative positioning accuracy of the nozzles for respective colors can be determined by the positional accuracy of the nozzles 11 formed in the nozzle plate 1.

By forming the nozzles 11 by electroforming, the nozzles 11 for the respective colors can be machined with accuracy of ±1 $\mu$m or higher since the positional accuracy of the nozzles 11 for the respective colors depends upon the accuracy of the lithography.

Figure 30:
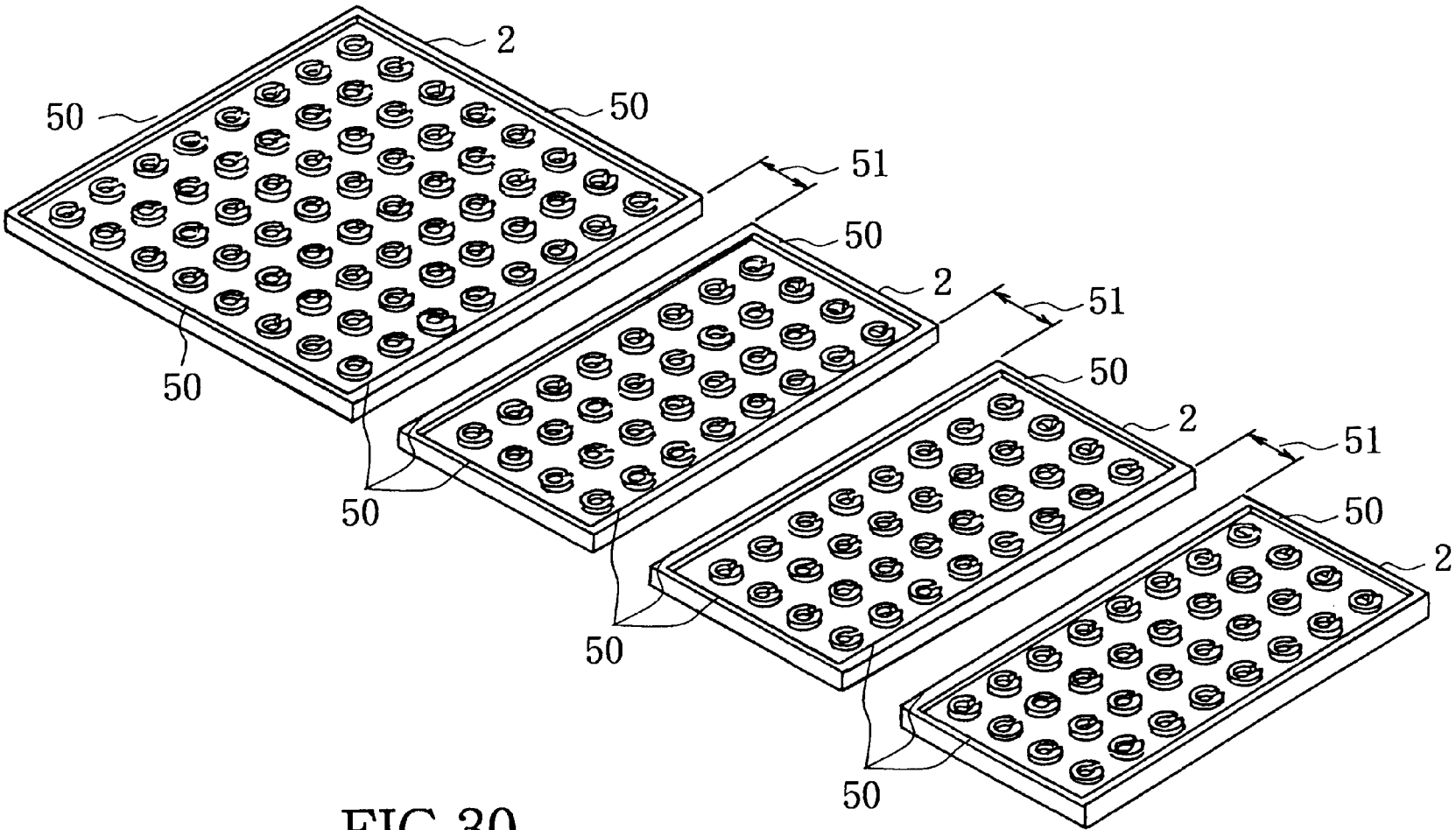
FIG. 30 is a perspective view showing a construction of an ink chamber plate used as a comparative example.

Further, the color recording head produced as the comparative example is formed by arranging the four color heads in parallel, spaces 51 between adjacent heads and spaces corresponding to a total thickness of three additional outer walls 50 between the color heads are required as shown in FIG. 30. However, since, in the seventh embodiment of the present invention, the separation between the adjacent colors can be provided by one outer wall 50, it is possible to substantially improve the mounting density of nozzles.

As described hereinbefore, according to the present invention, an ink jet type recording head having a simple structure can be manufactured easily. Since the number of manufacturing steps of the present recording head is small, it can be manufactured at low cost. Further, according to the present invention, the freedom of nozzle layout is high and the restriction for the position of ink supply ports and the number thereof is reduced. Further, since it is possible to arrange the nozzles two dimensionally, it is possible to substantially increase the nozzle density.

What is claimed is:

1. An ink jet recording head comprising:

a nozzle plate having a front surface formed with a plurality (n) of nozzles;

an ink chamber plate arranged substantially in parallel to a rear surface of said nozzle plate;

an outer partition wall arranged between said nozzle plate and said ink chamber plate to define an ink pool between said nozzle plate and said ink chamber plate;

a plurality of discrete partition walls arranged between said nozzle plate and said ink chamber plate and within said outer partition wall, each discrete partition wall associated with one of said nozzles and defining a discrete space communicating with the one of said nozzles;

an ink supply port formed in each of said discrete partition walls to supply ink from said ink pool to said discrete space defined thereby, said discrete partition walls separated from each other by said ink pool; and pressure generation means for separately pressurizing ink supplied from said ink pool through said ink supply ports to said discrete spaces.

2. An ink jet type recording head as claimed in claim 1, wherein said ink chamber plate is formed from a thin plate member capable of propagating mechanical vibration in a thickness direction thereof, and wherein said pressure generation means includes electro-mechanical transducer elements for separately imparting mechanical pressure to ink in said discrete spaces.

3. An ink jet type recording head as claimed in claim 1, wherein said pressure generating means includes heat-generating elements arranged within said respective discrete spaces and electric means for separately driving said heat generating elements.

4. An ink jet type recording head as claimed in claim 1, wherein said discrete partition walls are formed integrally on said ink chamber plate.

5. An ink jet type recording head as claimed in claim 1, wherein said discrete partition walls are formed integrally on said nozzle plate.

6. An ink jet type recording head as claimed in claim 1, wherein said nozzle plate is formed from a thick plate member having a rear surface formed with recesses communicating with respective said nozzles.

7. An ink jet type recording head as claimed in claim 6, wherein said recesses have centers coincident with axes of respective said nozzles.

8. An ink jet type recording head as claimed in claim 1, wherein each said discrete space has one or a plurality of said ink supply ports.

9. An ink jet type recording head as claimed in claim 8, wherein said one or the plurality of said ink supply ports are formed by partially removing said discrete partition wall.

10. An ink jet type recording head as claimed in claim 8, wherein an orientation of said ink supply port of one of said discrete spaces is different from orientations of said ink supply ports of other discrete spaces adjacent to said one discrete space.

11. An ink jet type recording head as claimed in claim 1, wherein the plurality of nozzles are arranged two dimensionally.

12. An ink jet type recording head as claimed in claim 11, wherein the plurality of said nozzles are arranged in a matrix.

13. An ink jet type recording head as claimed in claim 12, wherein the plurality of said nozzles are arranged in a main scan direction and in a sub scan direction.

14. An ink jet type recording head as claimed in claim 11, wherein the plurality of said nozzles are arranged at a predetermined angle with respect to the main scan direction.

15. An ink jet recording head comprising:

a nozzle plate formed with a plurality of nozzles;

an ink chamber plate arranged in a predetermined spaced relationship with said nozzle plate;

an outer partition wall arranged between said nozzle plate and said ink chamber plate to define an ink pool between said nozzle plate and said ink chamber plate with which said plurality of nozzles communicate;

a plurality of discrete partition walls arranged between said nozzle plate and said ink chamber plate and within said outer partition wall, each discrete partition wall surrounding and associated with a single nozzle so as to isolate the surrounded nozzle from the ink pool, each discrete partition wall defining a discrete space with which the surrounded nozzle communicates; and at least one ink supply port formed in each of said discrete partition walls to supply ink from said ink pool to said discrete space defined thereby.

* * * * *